US008778095B2

(12) United States Patent
Iwanaga et al.

(10) Patent No.: US 8,778,095 B2
(45) Date of Patent: Jul. 15, 2014

(54) METHOD OF MANUFACTURING GRAIN-ORIENTED ELECTRICAL STEEL SHEET

(75) Inventors: Isao Iwanaga, Tokyo (JP); Yoshiyuki Ushigami, Tokyo (JP); Norikazu Fujii, Tokyo (JP); Norihiro Yamamoto, Tokyo (JP); Masahide Uragoh, Tokyo (JP); Kenichi Murakami, Tokyo (JP); Chie Hama, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/699,526

(22) PCT Filed: May 19, 2011

(86) PCT No.: PCT/JP2011/061510

§ 371 (c)(1),
(2), (4) Date: Nov. 21, 2012

(87) PCT Pub. No.: WO2011/148849

PCT Pub. Date: Dec. 1, 2011

(65) Prior Publication Data

US 2013/0061985 A1 Mar. 14, 2013

(30) Foreign Application Priority Data

May 25, 2010 (JP) ..... 2010-119482

(51) Int. Cl.
*C23C 8/26* (2006.01)
*C23C 8/02* (2006.01)

(52) U.S. Cl.
USPC ..... 148/208; 148/230

(58) Field of Classification Search
USPC ..... 148/208, 230
See application file for complete search history.

(56) References Cited

U.S. PATENT DOCUMENTS 4,929,286 A 5/1990 Komatsu et al.
4,979,996 A 12/1990 Kobayashi et al.

(Continued)

FOREIGN PATENT DOCUMENTS

CN 1190132 A 8/1998
CN 101353760 A 1/2009

(Continued)

OTHER PUBLICATIONS

International Search Report for PCT/JP2011/061510 dated Aug. 9, 2011.

(Continued)

*Primary Examiner* — Jessee Roe
(74) *Attorney, Agent, or Firm* — Birch, Stewart, Kolasch & Birch, LLP

(57) ABSTRACT

In a method of manufacturing a grain-oriented electrical steel sheet including a nitriding treatment (step S7) and adopting so-called "low-temperature slab heating", the finish temperature of finish rolling in hot rolling (step S2) is set to 950° C. or below, the cooling is started within 2 seconds after completion of the finish rolling, and a steel strip is coiled at 700° C. or below. The cooling rate over the duration from the end of finish rolling to the start of coiling is set to 10° C./sec or above. In annealing (step S3) of the hot-rolled steel strip, the heating rate in the temperature range from 800° C. to 1000° C. is set to 5° C./sec or above.

17 Claims, 2 Drawing Sheets

(56) References Cited

U.S. PATENT DOCUMENTS

| | | | | |
|---|---|---|---|---|
| 5,039,359 | A * | 8/1991 | Yoshitomi et al. | 148/111 |
| 5,261,971 | A | 11/1993 | Yoshitomi et al. | |
| 5,885,371 | A | 3/1999 | Komatsubara et al. | |
| 6,039,818 | A | 3/2000 | Toge et al. | |
| 6,331,215 | B1 | 12/2001 | Toge et al. | |
| 2009/0126832 | A1 * | 5/2009 | Ushigami et al. | 148/208 |

FOREIGN PATENT DOCUMENTS

| | | | |
|---|---|---|---|
| JP | 62-040315 | A | 2/1987 |
| JP | 62-045285 | A | 2/1987 |
| JP | 01-309924 | A | 12/1989 |
| JP | 02-077525 | A | 3/1990 |
| JP | 02-274811 | A | 11/1990 |
| JP | 02-274812 | A | 11/1990 |
| JP | 04-154915 | A | 5/1992 |
| JP | 04-297524 | A | 10/1992 |
| JP | 08-092644 | A | 4/1996 |
| JP | 09-316537 | A | 12/1997 |
| JP | 10-121213 | A | 5/1998 |
| JP | 2002-030340 | A | 1/2002 |

OTHER PUBLICATIONS

Forms PCT/IB/338, PCT/IB/373 and PCT/IB/237 for International Application No. PCT/JP2011/061510 mailed Dec. 20, 2012.

Chinese Office Action, dated Jun. 28, 2013, for Chinese Application No. 201180025599.9 with a partial English translation.

* cited by examiner

METHOD OF MANUFACTURING GRAIN-ORIENTED ELECTRICAL STEEL SHEET

TECHNICAL FIELD

The present invention relates to a method of manufacturing a grain-oriented electrical steel sheet suitable for iron core and so forth of electric appliances.

BACKGROUND ART

A grain-oriented electrical steel sheet has been used as a material for composing an iron core of electric appliances such as transformer. It is important for a grain-oriented electrical steel sheet to be excellent in magnetization characteristics and iron loss characteristics. In recent years, there has been a growing demand for a grain-oriented electrical steel sheet characterized by small energy loss and low iron loss. Since a steel sheet having a large magnetic flux density generally has low iron loss, and may be downsized when used as an iron core, so that development thereof has very strongly been targeted at.

In order to improve a magnetic flux density of a grain-oriented electrical steel sheet, it is important to highly integrate the crystal grains to {110}<001> orientation called Goss orientation. Orientation of crystal grains is controlled making use of catastrophic grain growth called secondary recrystallization. Management of a structure obtained by a primary recrystallization before the secondary recrystallization (primary recrystallization structure), and management of fine precipitate called inhibitor such as AlN, or element segregated in the grain boundary hold the key for control of the secondary recrystallization. The inhibitor allows crystal grains having {110}<001> orientation to grow predominantly in the primary recrystallization structure, so as to suppress growth of crystal grains with other orientations.

One of the known method of producing the inhibitor is such as allowing AlN to deposit by nitriding conducted before the secondary recrystallization (Patent Document 5, for example). Still another known method totally different in mechanism is such as allowing AlN to deposit during annealing (hot-rolled sheet annealing), which takes place in the duration from hot rolling and cold rolling, without relying upon the nitriding (Patent Document 6, for example).

It is, however, difficult to effectively improve the magnetic flux density even with these techniques.

CITATION LIST

Patent Literature

Patent Literature 1: Japanese Examined Patent Publication No. 62-045285

Patent Literature 2: Japanese Laid-Open Patent Publication No. H02-077525

Patent Literature 3: Japanese Laid-Open Patent Publication No. S62-040315

Patent Literature 4: Japanese Laid-Open Patent Publication No. H02-274812

Patent Literature 5: Japanese Laid-Open Patent Publication No. H04-297524

Patent Literature 6: Japanese Laid-Open Patent Publication No. H10-121213

SUMMARY OF INVENTION

Technical Problem

It is therefore an object of the present invention to provide a method of manufacturing a grain-oriented electrical steel sheet, capable of effectively improving the magnetic flux density.

Solution to Problem

Aiming at controlling the primary recrystallization structure in the method of manufacturing a grain-oriented electrical steel sheet involving the nitriding process, the present inventors paid a special attention to conditions of finish rolling in the hot rolling. While the details will be given later, the present inventors found out that it is important to set the finish temperature in the finish rolling to 950° C. or below; to start cooling within 2 seconds after completion of the finish rolling; to set the cooling rate to 10° C./sec or above; and to set coiling temperature to 700° C. or below. When these conditions are satisfied, recrystallization and grain growth before annealing may be suppressed. The present inventors also found out that, for the case where the finish temperature in the finish rolling is set to 950° C. or below, it is important to set heating rate, within a predetermined temperature range (800° C. or above and 1000° C. or below) in the annealing (hot-rolled sheet annealing) after the hot rolling, to 5° C./sec or above. By the heating in this way, recrystallized grains may effectively be refined. The present inventors reached an idea that the {111}<112> orientation which generates at around the grain boundaries in the primary recrystallized structure may be increased by combining these conditions, thereby the degree of integration of the secondary recrystallized grains with the {110}<001> orientation may be increased, and the grain-oriented electrical steel sheet excellent in the magnetic characteristics may be manufactured. Note that, in the conventional method of manufacturing a grain-oriented electrical steel sheet (Patent Document 5, for example) involving the nitriding process, the heating rate in the hot-rolled sheet annealing has been determined while giving priority on productivity and stability, from the viewpoints of load exerted on facility and difficulty in temperature control.

Summary of the present invention is as follows.

(1)

A method of manufacturing a grain-oriented electrical steel sheet including:

heating a silicon steel slab at 1280° C. or below, the silicon steel slab containing, in % by mass, Si: 0.8% to 7%, and acid-soluble Al: 0.01% to 0.065%, with a C content of 0.085% or less, a N content of 0.012% or less, a Mn content of 1% or less, and a S equivalent Seq., defined by "Seq.=[S]+0.406×[Se]" where [S] being S content (%) and [Se] being Se content (%), of 0.015% or less, and the balance of Fe and unavoidable impurities;

hot rolling the heated silicon steel slab so as to obtain a hot-rolled steel strip;

annealing the hot-rolled steel strip so as to obtain an annealed steel strip;

cold rolling the annealed steel strip so as to obtain a cold-rolled steel strip;

decarburization annealing the cold-rolled steel strip so as to obtain a decarburization-annealed steel strip in which primary recrystallization is caused;

coating an annealing separating agent on the decarburization-annealed steel strip; and finish annealing the decarburization-annealed steel strip so as to cause secondary recrystallization, wherein the method further comprises performing a nitriding treatment in which a N content of the decarburization-annealed steel strip is increased between start of the decarburization annealing and occurrence of the secondary recrystallization in the finish annealing, the hot rolling the heated silicon steel slab comprises:

finish rolling with a finish temperature of 950° C. or below; and starting cooling within 2 seconds after completion of the finish rolling, and coiling at 700° C. or below, a heating rate of the hot-rolled steel strip within the temperature range from 800° C. to 1000° C. in the annealing the hot-rolled steel strip is 5° C./sec or above, and a cooling rate over a duration from the completion of the finish rolling up to a start of the coiling is 10° C./sec or above.

(2)

The method of manufacturing a grain-oriented electrical steel sheet according to (1), wherein a cumulative reduction in the finish rolling is 93% or above.

(3)

The method of manufacturing a grain-oriented electrical steel sheet according to (1) or (2), wherein a cumulative reduction in the last three passes in the finish rolling is 40% or above.

(4)

The method of manufacturing a grain-oriented electrical steel sheet according to any one of (1) to (3), wherein the silicon steel slab further contains Cu: 0.4% by mass.

(5)

The method of manufacturing a grain-oriented electrical steel sheet according to any one of (1) to (4), wherein the silicon steel slab further contains, in % by mass, at least one selected from the group consisting of Cr: 0.3% or less, P: 0.5% or less, Sn: 0.3% or less, Sb: 0.3% or less, Ni: 1% or less, Bi: 0.01% or less, B: 0.01% or less, Ti: 0.01% or less, and Te: 0.01% or less.

Advantageous Effects of Invention

According to the present invention, by combining the various conditions, a structure of the hot-rolled steel strip and so forth may be suitable for forming crystal grains with the Goss orientation, and thereby the degree of integration of the Goss orientation may be increased through the primary recrystallization and the secondary recrystallization. As a consequence, the magnetic flux density may be increased and the iron loss may be decreased in an effective manner.

DESCRIPTION OF EMBODIMENTS

Figure 1:
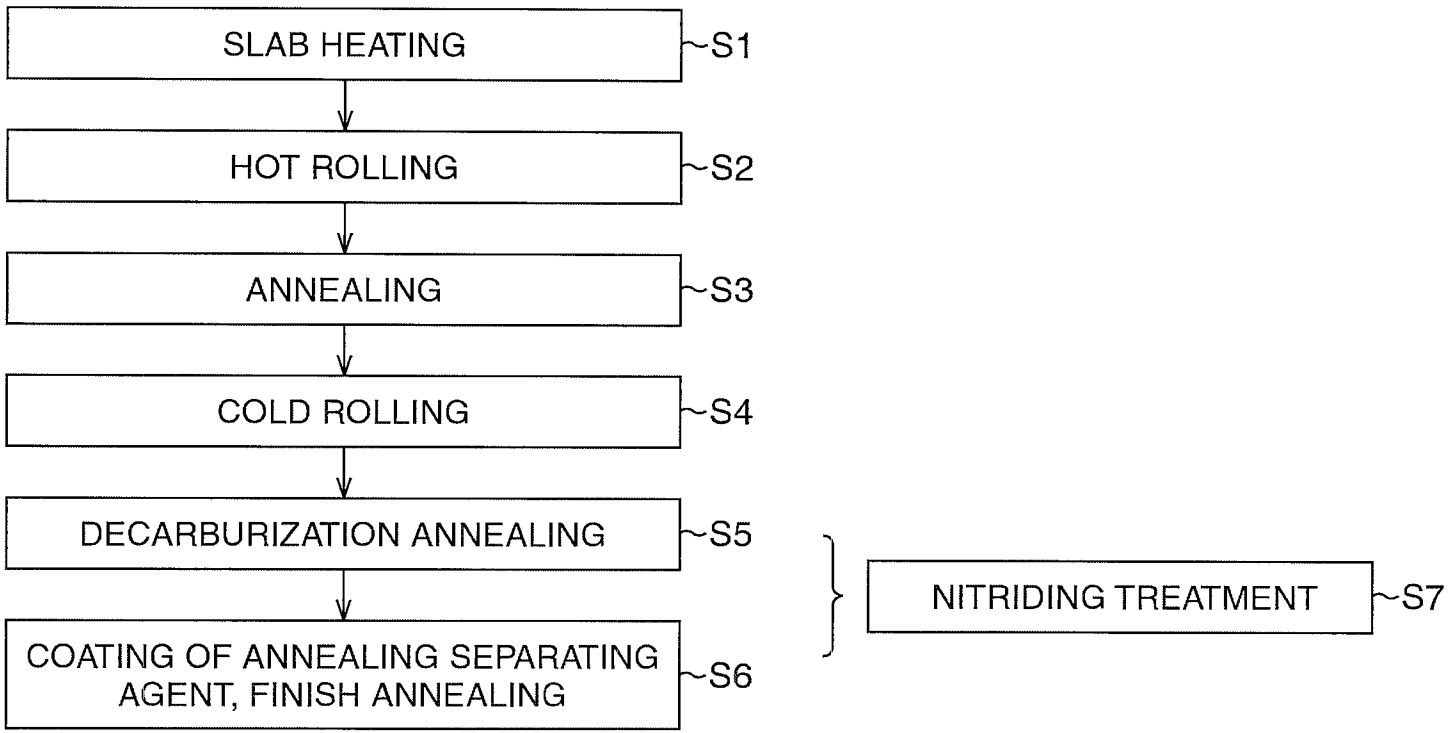
FIG. 1 is a flow chart illustrating a method of manufacturing a grain-oriented electrical steel sheet.

Embodiments of the present invention will be detailed below, referring to the attached drawings. FIG. 1 is a flow chart illustrating a method of manufacturing a grain-oriented electrical steel sheet.

First, as illustrated in FIG. 1, in step S1, a silicon steel material (slab) with a predetermined composition is heated to a predetermined temperature, and in step S2, the heated silicon steel material is hot rolled. As a result of the hot rolling, a hot-rolled steel strip is obtained. Thereafter, in step S3, the hot-rolled steel strip is annealed (hot-rolled sheet annealing) to thereby homogenize the structure in the hot-rolled steel strip and control precipitation of inhibitor. As a result of the annealing (hot-rolled sheet annealing), an annealed steel strip is obtained. Subsequently, in step S4, the annealed steel strip is cold rolled. The cold rolling may be conducted once, or may be repeated multiple times while conducting intermediate annealing in between. As a result of the cold rolling, a cold-rolled steel strip is obtained. For the case where the intermediate annealing is adopted, the annealing of the hot-rolled steel strip before the cold rolling is omissible, and instead the annealing may be implemented in the intermediate annealing (step S3). In other words, the annealing (step S3) may be effected on the hot-rolled steel strip, or on the steel strip once subjected to cold rolling and before the final cold rolling.

After the cold rolling, in step S5, decarburization annealing of the cold-rolled steel strip is performed. In the decarburization annealing, the primary recrystallization occurs. As a result of the decarburization annealing, a decarburization-annealed steel strip is obtained. Then, in step S6, an annealing separating agent containing MgO (magnesia) as a main component is coated over the surface of the decarburized steel strip, followed by finish annealing. During the finish annealing, the secondary recrystallization occurs, a glass coating mainly composed of forsterite is formed over the surface of the steel strip, and purification proceeds. As a result of the secondary recrystallization, a secondary recrystallization structure with the Goss orientation is obtained. As a result of the finish annealing, a finish-annealed steel strip is obtained. A nitriding treatment in which a N content of the steel strip is increased is performed, between start of the decarburization annealing and occurrence of the secondary recrystallization in the finish annealing (step S7).

The grain-oriented electrical steel sheet may be obtained in this way.

Reasons for limitation of the components of the silicon steel slab used in this embodiment will now be explained. In the description below, % means % by mass.

The silicon steel slab used in this embodiment may contain Si: 0.8% to 7%, and acid-soluble Al: 0.01% to 0.065%, a C content may be 0.085% or less, a N content may be 0.012% or less, a Mn content may be 1% or less, and a S equivalent Seq., defined by "Seq.=[S]+0.406×[Se]" where [S] being S content (%) and [Se] being Se content (%), may be 0.015% or less, and the balance may be Fe and unavoidable impurities. Cu: 0.4% or less may further be contained in the silicon steel slab. Also at least one selected from the group consisting of Cr: 0.3% or less, P: 0.5% or less, Sn: 0.3% or less, Sb: 0.3% or less, Ni: 1% or less, Bi: 0.01% or less, B: 0.01% or less, Ti: 0.01% or less, and Te: 0.01% or less may be contained.

Si contributes to increase the electric resistance and reduces the iron loss. Si content of less than 0.8% would result in only insufficient levels of these effects. Also the γ transformation would occur during the finish annealing (step S6), and thereby the crystal orientation would not fully be controlled. If the Si content exceeds 7%, the cold rolling (step S4) would be very difficult, so that the steel strip would crack in the process of cold rolling. Accordingly, the Si content is set to 0.8% to 7%. Taking the industrial productivity into account, the Si content is preferably 4.8% or less, and more preferably 4.0% or less. Also taking the above-described effects into account, the Si content is preferably 2.8% or above.

The acid-soluble Al combines with N to form (Al,Si)N, which serves as an inhibitor. The content of acid-soluble Al of less than 0.01% would result in only an insufficient amount of formation of inhibitor. The content of acid-soluble Al exceeding 0.065% would destabilize the secondary recrystallization. Accordingly, the content of acid-soluble Al is set to 0.01% to 0.065%. The content of acid-soluble Al is preferably 0.0018% or above, more preferably 0.022% or above. The content of acid-soluble Al is preferably 0.035% or less.

C is an element effective for controlling the primary recrystallization structure, but adversely affects the magnetic characteristics. The decarburization annealing (step S5) is implemented for this reason, wherein the C content exceeding 0.085% would require a longer time for the decarburization annealing, and would degrade the productivity. Accordingly, the C content is set to 0.085% or less, and preferably 0.08% or less. From the viewpoint of control of the primary recrystallization structure, the C content is preferably 0.05% or above.

N contributes to form AlN or the like which serves as an inhibitor. The N content exceeding 0.012% would, however, result in formation of void, called blister, in the steel strip during the cold rolling (step S4). Accordingly, the N content is set to 0.012% or less, and preferably to 0.01% or less. From the viewpoint of formation of the inhibitor, the N content is preferably 0.004% or above.

Mn contributes to increase the specific resistance and to reduce the iron loss. Mn also suppresses crack in the process of hot rolling (step S2). The Mn content exceeding 1% would, however, reduce the magnetic flux density. Accordingly, the Mn content is set to 1% or less, and preferably 0.8% or less. From the viewpoint of reduction in iron loss, the Mn content is preferably 0.05% or above. Mn also combines with S and/or Se, to thereby improve the magnetic characteristics. Accordingly, with the Mn content (% by mass) denoted as [Mn], a relation of "[Mn]/([S]+[Se])≥4" preferably holds.

S and Se exist in the steel strip as being combined with Mn, and contribute to improve the magnetic characteristics. However, if the S equivalent Seq. defined by "Seq.=[S]+0.406×[Se]" exceeds 0.015%, the magnetic characteristics are adversely affected. Accordingly, the S equivalent Seq. is set to 0.015% or less.

As described in the above, the silicon steel slab may contain Cu. Cu may contribute forming an inhibitor. However, if the Cu content exceeds 0.4%, dispersion of deposit would tend to be non-uniform, and thereby the effect of reducing the iron loss would saturate. Accordingly, the Cu content is set to 0.4% or less, and preferably 0.3% or less. From the viewpoint of formation of the inhibitor, the Cu content is preferably 0.05% or above.

As described in the above, the silicon steel slab may contain at least one selected from the group consisting of Cr: 0.3% or less, P: 0.5% or less, Sn: 0.3% or less, Sb: 0.3% or less, Ni: 1% or less, Bi: 0.01% or less, B: 0.01% or less, Ti: 0.01% or less, and Te: 0.01.

Cr is effective for improving an oxide layer formed over the surface of the steel strip during the decarburization annealing (step S5). If the oxide layer is improved, the glass coating formed so as to originate from the oxide layer in the process of finish annealing (step S6) is improved. The Cr content exceeding 0.3% would, however, degrade the magnetic characteristics. Accordingly, the Cr content is set to 0.3% or less. From the viewpoint of improving the oxide layer, the Cr content is preferably 0.02% or above.

P contributes to increase the specific resistance and reduce the iron loss. The P content exceeding 0.5% would, however, make cold rolling (step S4) difficult. Accordingly, the P content is set to 0.5% or less, and preferably 0.3% or less. From the viewpoint of reducing the iron loss, the P content is preferably 0.02% or above.

Sn and Sb are boundary segregation elements. In this embodiment, since the silicon steel slab contains acid-soluble Al, so that Al would be oxidized by water released from the annealing separating agent depending on conditions of the finish annealing (step S6). If Al is oxidized, inhibitor strength would vary from site to site in the coiled steel strip, and thereby the magnetic characteristics would vary. In contrast, when the Sn and/or Sb are contained as the boundary segregation elements, the oxidation of Al may be suppressed, and thereby the magnetic characteristics may be suppressed from varying. The Sn content exceeding 0.3% would, however, make the oxide layer less likely to be formed during the decarburization annealing (step S5), and thereby the glass coating would be formed only to an insufficient degree. This would also make the decarburization annealing (step S5) very difficult. The same will apply also to the case where the Sb content exceeds 0.3%. Accordingly, the Sn content and the Sb content are set to 0.3% or less. From the viewpoint of suppressing the oxidation of Al, the Sn content and the Sb content are preferably 0.02% or above.

Ni contributes to increase the specific resistance and to reduce the iron loss. Ni is an effective element also in view of controlling the metal structure of the hot-rolled steel strip, and improving the magnetic characteristics. The Ni content exceeding 1% would, however, destabilize the secondary recrystallization in the process of finish annealing (step S6). Accordingly, the Ni content is set to 1% or less, preferably 0.3% or less. From the viewpoint of improving the magnetic characteristics such as decreasing the iron loss, the Ni content is preferably 0.02% or above.

Bi, B, Ti, and Te contribute to stabilize the deposit such as sulfide, and to enhance their functions as the inhibitor. The Bi content exceeding 0.01% would, however, adversely affect the formation of the glass coating. The same will apply also for the case where the B content exceeds 0.01%, where the Ti content exceeds 0.01%, and where the Te content exceeds 0.01%. Accordingly, the Bi content, the B content, the Ti content, and the Te content are set to 0.01% or less. From the viewpoint of enhancing the inhibitor, the Bi content, B content, Ti content, and Te content are preferably 0.0005% or above.

The silicon steel slab may further contain elements other than those described in the above, and/or, other unavoidable impurities, so long as the magnetic characteristics will not be degraded.

Next, conditions of the individual steps in this embodiment will be explained.

In the heating of the slab in step S1, the silicon steel slab is heated at 1280° C. or below. In other words, the slab is heated by so-called low-temperature slab heating in this embodiment. In an exemplary process of manufacturing the silicon steel slab, a steel containing the above-described components is melt in a converter or electric furnace to thereby obtain a molten steel. Next, the molten steel is degassed in vacuo as necessary, which is followed by continuous casting of the molten steel, or, ingot casting, blooming and rolling. Thickness of the silicon steel slab is typically 150 mm to 350 mm, and preferably 220 mm to 280 mm. The silicon steel slab may alternatively be formed into a thin slab of 30 mm to 70 mm thick. When the thin slab is used, rough rolling preceding the finish rolling in the hot rolling (step S2) may be omissible.

By setting the temperature of heating at 1280° C. or below, the precipitates in the silicon steel slab may fully be precipitated, the geometry thereof may be made uniform, and thereby formation of skid mark is avoidable. The skid mark is a typical expression of an in-coil variation of the secondary recrystallization behavior. By the strategy, also various problems associated with heating at higher temperatures (so-called high-temperature slab heating) are avoidable. Problems associated with the high-temperature slab heating include necessity of a dedicated heating furnace, and a large amount of scale generated during melting.

The lower the temperature of heating slab, the better the magnetic characteristics. While the lower limit value of the temperature of heating slab is therefore not specifically limited, too low temperature of heating would make the hot rolling, subsequent to the heating of the slab, difficult and would thereby degrade the productivity. Accordingly, the temperature of heating slab is preferably set to 1280° C. or below, taking the productivity into account.

In the hot rolling in step S2, for example, the silicon steel slab is subjected to rough rolling, and then subjected to finish rolling. For the case where the thin slab is used as described in the above, the rough rolling may be omissible. In this embodiment, the finish temperature of finish rolling is set to 950° C. or below. By setting the finish temperature of the finish rolling to 950° C. or below, as clearly known from the results of a first experiment described later, the magnetic characteristics may be improved in an effective manner.

(First Experiment)

Now, a first experiment will be explained. In the first experiment, relation between the finish temperature of the finish rolling in hot rolling and the magnetic flux density B8 was investigated. The magnetic flux density B8 herein is defined by the one observed when the grain-oriented electrical steel sheet is applied with a magnetic field of 800 A/m at 50 Hz.

First, a silicon steel slab of 40 mm thick containing, in % by mass, Si: 3.24%, C: 0.054%, acid-soluble Al: 0.028%, N: 0.006%, Mn: 0.05%, and S: 0.007%, and composed of the balance of Fe and unavoidable impurities, was manufactured. Then, the silicon steel slab was heated at 1150° C., and then subjected to hot rolling to obtain a hot-rolled steel strip of 2.3 mm thick. The finish temperature of the finish rolling herein was varied in the range from 750° C. to 1020° C. A cumulative reduction in the finish rolling was set to 94.3%, and a cumulative reduction in the last three passes in the finish rolling was set to 45%. The cooling was started one second after the completion of the finish rolling, and the steel strip was coiled at a coiling temperature of 540° C. to 560° C. Cooling rate over the duration from the start of cooling up to the coiling was set to 16° C./sec.

Then, the hot-rolled steel strip was annealed. In this annealing, the hot-rolled steel strip was heated at a heating rate of 7.2° C./sec over the duration in which the hot-rolled steel strip was in the temperature range from 800° C. to 1000° C., and kept at 1100° C. Thereafter, the steel strip after the annealing was cold rolled down to a thickness of 0.23 mm, to thereby obtain a cold-rolled steel strip. Subsequently, the cold-rolled steel strip was subjected to decarburization annealing at 850° C. so as to proceed the primary recrystallization, and then further annealed in an ammonia-containing atmosphere for nitriding. By the nitriding, the N content of the steel strip was increase up to 0.019% by mass. Next, the steel strip was coated with an annealing separating agent containing MgO as a main component, and then subjected to finish annealing at 1200° C. for 20 hours, to thereby allow the secondary recrystallization to proceed.

Figure 2:
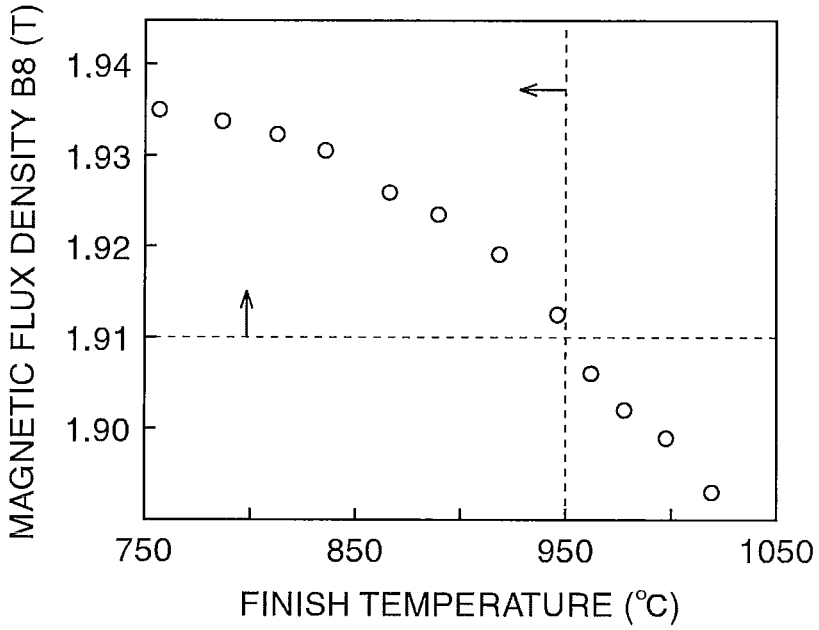
FIG. 2 is a chart illustrating results of a first experiment.

The magnetic flux density B8 of the steel strip after the finish annealing was measured as the magnetic characteristic. In the measurement of magnetic flux density B8, "Methods of measurement of the magnetic properties of magnetic steel sheet and strip by means of a single sheet tester" (SST test) specified by JIS C2556 was adopted, with a single sheet sample of 60 mm×300 mm. Results are illustrated in FIG. 2. It is known from FIG. 2 that a magnetic flux density of as high as 1.91 T or above may be obtained at a finish temperature of the finish rolling of 950° C. or below.

While the reason why a large magnetic flux density may be obtained by setting the finish temperature of the finish rolling to 950° C. or below is not fully clarified, it is supposed as follows. If strain is accumulated in the steel strip during the hot rolling, and if the finish temperature of the finish rolling is set to 950° C. or below, the strain is maintained. As the strain accumulates, in the process of decarburization (step S5), the primary recrystallization structure (texture) which contributes to generate crystal grains with the Goss orientation is obtained. The primary recrystallization structure contributive to generation of the crystal grains with the Goss orientation is exemplified by a texture with the (111)<112> orientation.

The lower the finish temperature of the finish rolling, the better the magnetic characteristics. Accordingly, while the lower limit value of the finish temperature is not specifically limited, too low finish temperature would make the finish rolling difficult to thereby degrade the productivity. It is therefore preferable to set the finish temperature to 950° C. or below taking the productivity into account. For example, the finish temperature is preferably set to 750° C. or above, and 900° C. or below.

A cumulative reduction in the finish rolling is preferably set to 93% or above. This is because, by setting the cumulative reduction in the finish rolling to 93% or above, the magnetic characteristics may be improved. The cumulative reduction in the last three passes is preferably set to 40% or above, and more preferably 45% or above. This is because, also by setting the cumulative reduction in the last three passes to 40% or above, and particularly 45% or above, the magnetic characteristics may be improved. This is also supposedly because the accumulation of strain introduced by the hot rolling increases with the elevation of the cumulative reduction. From the viewpoint of rolling capacity and so forth, the cumulative reduction in the finish rolling is preferably set to 97% or less, and the cumulative reduction in the last three passes is preferably set to 60% or less.

In this embodiment, the cooling is started within 2 seconds after completion of the finish rolling. If the interval from the end of finish rolling up to the start of cooling exceeds 2 seconds, the recrystallization would tend to proceed nonuniformly, while being associated with variation in temperature in the longitudinal direction (rolling direction) and the widthwise direction of the steel strip, and thereby the strain having been accumulated increasingly by the hot rolling is unfortunately released. Accordingly, the interval from the end of finish rolling up to the start of cooling is set to 2 seconds or shorter.

In this embodiment, the steel strip is coiled at a temperature of 700° C. or below. In other words, the coiling temperature is set to 700° C. or lower. If the coiling temperature exceeds 700° C., the recrystallization would tend to proceed nonuniformly, while being associated with variation in temperature in the longitudinal direction (rolling direction) and the widthwise direction of the steel strip, and thereby the strain having been accumulated increasingly by the hot rolling is unfortunately released. Accordingly the coiling temperature is set to 700° C. or lower.

The lower the coiling temperature, the better the magnetic characteristics. Accordingly, while the lower limit value of the coiling temperature is not specifically limited, too low coiling temperature would increase the interval up to the start of coiling, to thereby degrade the productivity. Accordingly, the coiling temperature is preferably set to 700° C. or below taking the productivity into account. For example, the coiling temperature is preferably set to 450° C. or above, and 600° C. or below.

In this embodiment, the cooling rate (for example, average cooling rate) in the duration from the completion of the finish rolling up to the start of the coiling is set to 10° C./sec or above. If the cooling rate is smaller than 10° C./sec, the recrystallization would tend to proceed nonuniformly, while being associated with variation in temperature in the longitudinal direction (rolling direction) and the width-wise direction of the steel strip, and thereby the strain having been accumulated increasingly by the hot rolling is unfortunately released. Accordingly, the cooling rate is set to 10° C./sec or above. While the upper limit value of the cooling rate is not specifically limited, it is preferably set to 10° C./sec or above, taking capacity of a cooling facility and so forth into account.

In the annealing in step S3, in continuous annealing, for example, the heating rate (for example, average heating rate) in the temperature range of the hot-rolled steel strip from 800° C. to 1000° C. is set to 5° C./sec or above. By setting the heating rate in the temperature range from 800° C. to 1000° C. to 5° C./sec or above, the magnetic characteristics may be improved in an effective manner, as will be clear from a second experiment described in the next.

(Second Experiment)

Now, a second experiment will be explained. In the second experiment, relation between the heating rate in the annealing (step S2) and the magnetic flux density B8 was investigated.

First, a silicon steel slab of 40 mm thick containing, in % by mass, Si: 3.25%, C: 0.057%, acid-soluble Al: 0.027%, N: 0.004%, Mn: 0.06%, S: 0.011%, and Cu: 0.1%, and composed of the balance of Fe and unavoidable impurities was manufactured. Then, the silicon steel slab was heated at 1150° C., and then subjected to hot rolling to obtain a hot-rolled steel strip of 2.3 mm thick. The finish temperature of the finish rolling herein was set to 830° C. The cumulative reduction in the finish rolling was set to 94.3%, and the cumulative reduction in the last three passes in the finish rolling was set to 45%. The cooling was started one second after the completion of the finish rolling, and the steel strip was coiled at a coiling temperature of 530° C. to 550° C. Cooling rate over the duration from the start of cooling up to the coiling was set to 16° C./sec.

Then, the hot-rolled steel strip was annealed. In this annealing, the hot-rolled steel strip was heated at a heating rate of 3° C./sec to 8° C./sec over the duration in which the hot-rolled steel strip was in the temperature range from 800° C. to 1000° C., and kept at 1100° C. Thereafter, the steel strip after the annealing was cold rolled down to a thickness of 0.23 mm, to thereby obtain a cold-rolled steel strip. Subsequently, the cold-rolled steel strip was subjected to decarburization annealing at 850° C. so as to proceed the primary recrystallization, and then further annealed in an ammonia-containing atmosphere for nitriding. By the nitriding, the N content of the steel strip was increased up to 0.017% by mass. Then, the steel strip was coated with an annealing separating agent containing MgO as a main component, and then subjected to finish annealing at 1200° C. for 20 hours, to thereby allow the secondary recrystallization to proceed.

Figure 3:
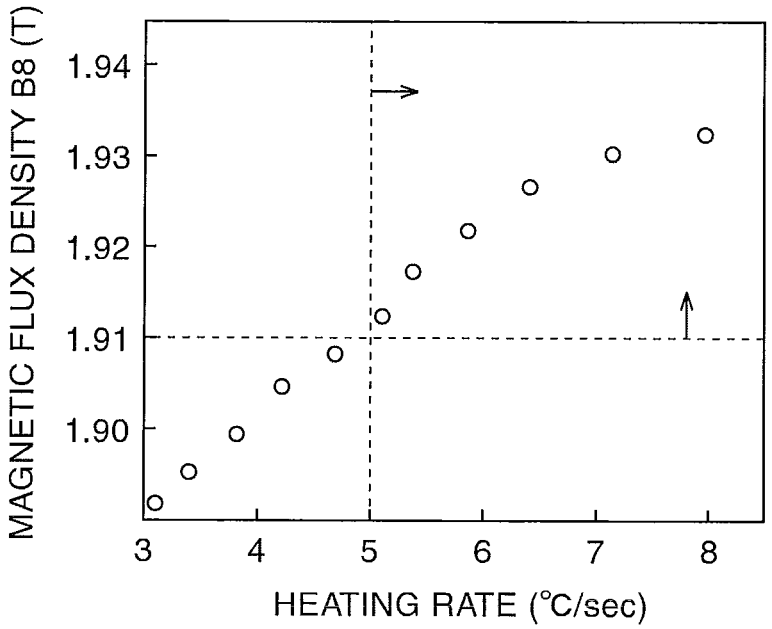
FIG. 3 is a chart illustrating results of a second experiment.

Then, similarly to the first experiment, the magnetic flux density B8 of the steel strip after the finish annealing was measured as the magnetic characteristic. Results are illustrated in FIG. 3. It is known from FIG. 3 that, by setting the heating rate of the hot-rolled steel strip in the temperature range from 800° C. to 1000° C. of 5° C./sec or above, a magnetic flux density B8 of as high as 1.91 T or above may be obtained.

While the reason why a large magnetic flux density may be obtained by setting the heating rate to 5° C./sec or above is not fully clarified, it is supposed as follows. That is, by the rapid heating at 5° C./sec or above, it is supposed that the strain accumulated during the hot rolling may effectively be used for promoting refining of the crystal grains, and thereby a texture contributive to generation of the crystal grains with the Goss orientation may be obtained.

While the annealing temperature in step S3 is not specifically limited, it is preferably set to 1000° C. to 1150° C., in order to clear non-uniformity in the crystal structure and dispersion of deposit due to difference in temperature history caused in the hot rolling. The annealing temperature exceeding 150° C. would dissolve the inhibitor. From these points of view, the annealing temperature is preferably set to 1050° C. or above, and is also preferably set to 1100° C. or below.

It is preferable that the number of times of repetition of the cold rolling in step S4 is appropriately selected depending on required characteristics and cost of the grain-oriented electrical steel sheet to be manufactured. The final cold rolling ratio is preferably set to 80% or above. This is for the purpose of promoting orientation of the primary recrystallized grains such as in {111} in the process of decarburization annealing (step S5), and of increasing the degree of integration of the secondary recrystallized grains with the Goss orientation.

The decarburization annealing in step S5 is proceeded in a moist atmosphere, for example, in order to remove C contained in the cold-rolled steel strip. During the decarburization annealing, the primary recrystallization occurs. While temperature of the decarburization annealing is not specifically limited, by setting it to 800° C. to 900° C., for example, the grain radius achieved in the primary recrystallization is approximately 7 μm to 18 μm, which ensures more stable expression of the secondary recrystallization. In other words, a more excellent grain-oriented electrical steel sheet may be manufactured.

The nitriding treatment in step S7 is proceeded before the secondary recrystallization occurs during the finish annealing in step S6. By the nitriding, N is allowed to intrude into the steel strip, so as to form (Al,Si)N, which functions as the inhibitor. By the formation of (Al,Si)N, the grain-oriented electrical steel sheet with a large magnetic flux density may be manufactured in a stable manner. The nitriding may be exemplified by a process of annealing, subsequent to the decarburization annealing, in an atmosphere containing a gas with a nitriding ability such as ammonia; and a process of adding a powder having a nitriding ability such as MnN to the annealing separating agent so as to accomplish the nitriding during the finish annealing.

In step S6, the annealing separating agent containing magnesia as a main component, for example, is coated over the steel strip, followed by the finish annealing, to thereby allow the crystal grains with the {110}<001> orientation (Goss orientation) to predominantly grow by the secondary recrystallization.

As described in the above, in this embodiment, the finish temperature of the finish rolling in the hot rolling (step S2) is set to 950° C. or below, the cooling is started within 2 seconds after the completion of the finish rolling, the coiling is conducted at a temperature of 700° C. or below, the heating rate in the temperature range of 800° C. to 1000° C. in the process of annealing (step S3) is set to 5° C./sec or above, and the cooling rate over the duration from the end of finish rolling up to the start of coiling is set to 10° C./sec or above. By combining these various conditions, an excellent level of magnetic characteristics may be obtained. The reason why, partially described in the above, is supposedly as follows.

By setting the finish temperature of the finish rolling to 950° C. or below, the interval up to the start of cooling to 2 seconds or shorter, the cooling rate to 10° C./sec or above, and the coiling temperature to 700° C. or below, strains accumulated during the hot rolling is maintained, and thereby recrystallization is suppressed up to the start of annealing (step S3). In other words, the rolling strain is maintained through work hardening by rolling and suppression of recrystallization. In addition, by setting the heating rate in the temperature range from 800° C. to 1000° C. to 5° C./sec or above, refining of the recrystallized grains is promoted. By the continuous annealing, variation in temperature in the longitudinal direction (rolling direction) and in the width-wise direction may be suppressed, to thereby allow a uniform recrystallization to proceed. In the process of decarburization annealing (step S5) subsequent to cold rolling (step S4), the primary recrystallization occurs, in which crystal grains with the {111}<112> orientation are likely to grow from the vicinity of the grain boundary. The crystal grains with the {111}<112> orientation contributes to predominant growth of crystal grains with the {110}<001> orientation (Goss orientation). In other words, a good primary recrystallization structure may be obtained. Accordingly, when the secondary recrystallization occurs during the finish annealing (step S6), a structure accumulated in the {110}<001> orientation (Goss orientation) and very suitable for improving the magnetic characteristics may be obtained in a stable manner.

EXAMPLE

Next, experiments conducted by the present inventors will be explained. Conditions in these experiments were adopted merely for the purpose of confirming feasibility and effects of the present invention, so that the present invention is by no means limited thereto.

Example 1

In Example 1, silicon steel slabs of 40 mm thick were manufactured using steels S1 to S7 each containing the components listed in Table 1, and composed of the balance of Fe and unavoidable impurities. Next, each silicon steel slab was heated at 1150° C., and then hot-rolled to obtain a hot-rolled steel strip of 2.3 mm thick. In this process, the finish temperature of the finish rolling was varied in the range from 845° C. to 855° C. The cumulative reduction in the finish rolling was set to 94%, and the cumulative reduction in the last three passes in the finish rolling was set to 45%. The cooling was started one second after the completion of the finish rolling, and the steel strip was coiled at a coiling temperature of 490° C. to 520° C. The cooling rate over the duration from the start of cooling up to the coiling was set to 13° C./sec to 14° C./sec.

Then, each hot-rolled steel strip was annealed. In this annealing, the hot-rolled steel strip was heated at a heating rate of 7° C./sec over the duration in which the hot-rolled steel strip was in the temperature range from 800° C. to 1000° C., and then kept at 1100° C. Thereafter, the steel strip after the annealing was cold-rolled down to a thickness of 0.23 mm, to thereby obtain a cold-rolled steel strip. Subsequently, the cold-rolled steel strip was subjected to decarburization annealing at 850° C. so as to allow the primary recrystallization to occur, followed by annealing in an ammonium-containing atmosphere for nitriding. By the nitriding, the N content of the steel strip was increased up to 0.016% by mass. Next, the steel strip was coated with an annealing separating agent containing MgO as main component, and then subjected to finish annealing at 1200° C. for 20 hours, to thereby allow the secondary recrystallization to occur.

Then, similarly as described in the first experiment and the second experiment, the magnetic flux density B8 of the steel strip after the finish annealing was measured as the magnetic characteristic. Results are listed in Table 2.

TABLE 1

| | CHEMICAL COMPONENT (MASS %) | | | | | | | | | | | | | | |
|---|---|---|---|---|---|---|---|---|---|---|---|---|---|---|---|
| STEEL | C | Si | Mn | ACID-SOLUBLE Al | N | S | Se | Seq. | Cu | Cr | P | Sn | Sb | Ni | Bi |
| S1 | 0.065 | 3.25 | 0.11 | 0.026 | 0.007 | 0.008 | — | 0.008 | 0.2 | — | — | — | — | — | — |
| S2 | 0.061 | 3.25 | 0.11 | 0.027 | 0.007 | 0.007 | — | 0.007 | — | 0.1 | — | — | — | — | — |
| S3 | 0.060 | 3.23 | 0.11 | 0.027 | 0.009 | 0.007 | — | 0.007 | — | — | 0.1 | — | — | — | — |
| S4 | 0.064 | 3.24 | 0.11 | 0.028 | 0.006 | 0.007 | — | 0.007 | — | — | — | 0.1 | — | — | — |
| S5 | 0.061 | 3.23 | 0.11 | 0.026 | 0.008 | 0.006 | 0.005 | 0.008 | — | — | — | — | 0.1 | — | — |
| S6 | 0.059 | 3.25 | 0.11 | 0.025 | 0.007 | 0.007 | — | 0.007 | — | — | — | — | — | 0.2 | — |
| S7 | 0.062 | 3.24 | 0.11 | 0.027 | 0.008 | 0.007 | — | 0.007 | — | — | — | — | — | — | 0.006 |

NOTE)
"—" MEANS THE CHEMICANL COMPONENT IS NOT INTENTIONALLY ADDED

TABLE 2

| | | CONDITIONS OF FINISH ROLLING | | | CONDITIONS OF COOLING AFTER FINISH ROLLING | | | CONDITIONS OF HOT-ROLLED STEEL ANNEALING | | |
|---|---|---|---|---|---|---|---|---|---|---|
| | | CUMULATIVE | | | | | | | | |
| SAMPLE No. | STEEL | CUMULATIVE REDUCTION (%) | REDUCTION IN THE LAST THREE PASSES (%) | FINISH TEMPERATURE (° C.) | TIME TO START OF COOLING (SEC) | AVERAGE COOLING RATE (° C./SEC) | COILING TEMPERATURE (° C.) | HEATING RATE (° C./SEC) | ANNEALING TEMPERATURE (° C.) | MAGNETIC FLUX DENSITY B8 (T) |
| 1-1 | S1 | 94 | 45 | 848 | 1 | 14 | 500 | 7 | 1100 | 1.932 |
| 1-2 | S2 | 94 | 45 | 854 | 1 | 13 | 490 | 7 | 1100 | 1.929 |

TABLE 2-continued

| SAMPLE No. | STEEL | CONDITIONS OF FINISH ROLLING: CUMULATIVE REDUCTION (%) | CUMULATIVE REDUCTION IN THE LAST THREE PASSES (%) | FINISH TEMPERATURE (° C.) | CONDITIONS OF COOLING AFTER FINISH ROLLING: TIME TO START OF COOLING (SEC) | AVERAGE COOLING RATE (° C./SEC) | COILING TEMPERATURE (° C.) | CONDITIONS OF HOT-ROLLED STEEL ANNEALING: HEATING RATE (° C./SEC) | ANNEALING TEMPERATURE (° C.) | MAGNETIC FLUX DENSITY B8 (T) |
|---|---|---|---|---|---|---|---|---|---|---|
| 1-3 | S3 | 94 | 45 | 851 | 1 | 13 | 520 | 7 | 1100 | 1.930 |
| 1-4 | S4 | 94 | 45 | 847 | 1 | 14 | 500 | 7 | 1100 | 1.932 |
| 1-5 | S5 | 94 | 45 | 855 | 1 | 13 | 510 | 7 | 1100 | 1.930 |
| 1-6 | S6 | 94 | 45 | 849 | 1 | 14 | 520 | 7 | 1100 | 1.929 |
| 1-7 | S7 | 94 | 45 | 852 | 1 | 14 | 500 | 7 | 1100 | 1.932 |

As is known from Table 2, samples No. 1-1 to No. 1-7, all satisfying the conditions specified by the present invention, were found to show large values of magnetic flux density B8.

Example 2

In Example 2, silicon steel slabs of 40 mm thick were manufactured using a steel S11 containing the components listed in Table 1, and composed of the balance of Fe and unavoidable impurities. Then, each silicon steel slab was heated at 1150° C., and then hot-rolled to obtain a hot-rolled steel strip of 2.3 mm thick. In this process, the cumulative reduction in the finish rolling, the cumulative reduction in the last three passes, and the finish temperature were set as listed in Table 4. Each steel strip was started to cool after the elapse of time listed in Table 4 after completion of the finish rolling, and coiled at a coiling temperature listed in Table 4. The interval from the start of cooling up to the coiling was set to any of the values listed in Table 4.

Then, each hot-rolled steel strip was annealed. In this annealing, the heating rate over the duration in which the hot-rolled steel strip was in the temperature range from 800° C. to 1000° C., was set to any of the values listed in Table 4, and kept at 1100° C. Thereafter, the steel strip after the annealing was cold rolled down to a thickness of 0.23 mm, to thereby obtain a cold-rolled steel strip. Subsequently, the cold-rolled steel strip was subjected to decarburization annealing at 850° C. so as to proceed the primary recrystallization, and then further annealed in an ammonia-containing atmosphere for nitriding. By the nitriding, the N content of the steel strip was increase up to 0.016% by mass. Then, the steel strip was coated with an annealing separating agent containing MgO as a main component, and then subjected to finish annealing at 1200° C. for 20 hours, to thereby allow the secondary recrystallization to occur.

Then, similarly as described in Example 1, the magnetic flux density B8 of the steel strip after the finish annealing was measured as the magnetic characteristic. Results are listed in Table 4, together with the results of Example 1.

TABLE 3

| STEEL | CHEMICAL COMPONENT (MASS %): C | Si | Mn | ACID-SOLUBLE Al | N | Seq. |
|---|---|---|---|---|---|---|
| S11 | 0.062 | 3.24 | 0.11 | 0.029 | 0.008 | 0.007 |

TABLE 4

| | SAMPLE No. | STEEL | CONDITIONS OF FINISH ROLLING: CUMULATIVE REDUCTION (%) | CUMULATIVE REDUCTION IN THE LAST THREE PASSES (%) | FINISH TEMPERATURE (° C.) | CONDITIONS OF COOLING AFTER FINISH ROLLING: TIME TO START OF COOLING (SEC) | AVERAGE COOLING RATE (° C./SEC) | COILING TEMPERATURE (° C.) | CONDITIONS OF HOT-ROLLED STEEL ANNEALING: HEATING RATE (° C./SEC) | ANNEALING TEMPERATURE (° C.) | MAGNETIC FLUX DENSITY B8 (T) |
|---|---|---|---|---|---|---|---|---|---|---|---|
| EXAMPLES | 1-1 | S1 | 94 | 45 | 848 | 1 | 14 | 500 | 7 | 1100 | 1.932 |
| | 1-2 | S2 | 94 | 45 | 854 | 1 | 13 | 490 | 7 | 1100 | 1.929 |
| | 1-3 | S3 | 94 | 45 | 851 | 1 | 13 | 520 | 7 | 1100 | 1.930 |
| | 1-4 | S4 | 94 | 45 | 847 | 1 | 14 | 500 | 7 | 1100 | 1.932 |
| | 1-5 | S5 | 94 | 45 | 855 | 1 | 13 | 510 | 7 | 1100 | 1.930 |
| | 1-6 | S6 | 94 | 45 | 849 | 1 | 14 | 520 | 7 | 1100 | 1.929 |
| | 1-7 | S7 | 94 | 45 | 852 | 1 | 14 | 500 | 7 | 1100 | 1.932 |
| | 2-1 | S11 | 92 | 38 | 754 | 1 | 13 | 500 | 7 | 1100 | 1.935 |
| | 2-2 | S11 | 92 | 38 | 947 | 1 | 14 | 680 | 7 | 1100 | 1.912 |
| | 2-3 | S11 | 92 | 38 | 861 | 2 | 14 | 670 | 7 | 1100 | 1.915 |
| | 2-4 | S11 | 92 | 38 | 822 | 1 | 10 | 650 | 7 | 1100 | 1.928 |
| | 2-5 | S11 | 92 | 38 | 906 | 1 | 11 | 700 | 7 | 1100 | 1.919 |
| | 2-6 | S11 | 92 | 38 | 875 | 1 | 14 | 640 | 5 | 1100 | 1.918 |
| | 2-7 | S11 | 93 | 38 | 818 | 1 | 14 | 540 | 7 | 1100 | 1.933 |
| | 2-8 | S11 | 94 | 40 | 821 | 1 | 13 | 550 | 7 | 1100 | 1.934 |
| | 2-9 | S11 | 94 | 45 | 757 | 1 | 14 | 510 | 7 | 1100 | 1.936 |
| COMPARATIVE | 2-11 | S11 | 92 | 38 | 958 | 1 | 14 | 680 | 7 | 1100 | 1.906 |
| | 2-12 | S11 | 92 | 38 | 840 | 3 | 14 | 630 | 7 | 1100 | 1.888 |
| | 2-13 | S11 | 92 | 38 | 901 | 1 | 7 | 680 | 7 | 1100 | 1.891 |

TABLE 4-continued

| | SAMPLE No. | STEEL | CONDITIONS OF FINISH ROLLING: CUMULATIVE REDUCTION (%) | CUMULATIVE REDUCTION IN THE LAST THREE PASSES (%) | FINISH TEMPERATURE (° C.) | CONDITIONS OF COOLING AFTER FINISH ROLLING: TIME TO START OF COOLING (SEC) | AVERAGE COOLING RATE (° C./SEC) | COILING TEMPERATURE (° C.) | CONDITIONS OF HOT-ROLLED STEEL ANNEALING: HEATING RATE (° C./SEC) | ANNEALING TEMPERATURE (° C.) | MAGNETIC FLUX DENSITY B8 (T) |
|---|---|---|---|---|---|---|---|---|---|---|---|
| EXAMPLES | 2-14 | S11 | 92 | 38 | 842 | 2 | 10 | 750 | 7 | 1100 | 1.897 |
| | 2-15 | S11 | 92 | 38 | 837 | 1 | 14 | 590 | 3 | 1100 | 1.904 |

As is known from Table 4, samples No. 2-1 to No. 2-9, all satisfying the conditions specified by the present invention, were found to show large values of magnetic flux density B8. On the other hand, samples No. 2-11 to No. 2-15, all do not satisfies any of the conditions specified by the present invention, were found to show small values of magnetic flux density B8.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

INDUSTRIAL APPLICABILITY

The present invention is applicable, for example, to industries related to manufacturing of electrical steel sheet and industries using electrical steel sheet.

The invention claimed is:

1. A method of manufacturing a grain-oriented electrical steel sheet comprising:

heating a silicon steel slab at 1280° C. or below, the silicon steel slab containing, in % by mass, Si: 0.8% to 7%, and acid-soluble Al: 0.01% to 0.065%, with a C content of 0.085% or less, a N content of 0.012% or less, a Mn content of 1% or less, and a S equivalent Seq., defined by "Seq.=[S]+0.406×[Se]" where [S] being S content (%) and [Se] being Se content (%), of 0.015% or less, a Cu content of 0.4% or less, and the balance of Fe and unavoidable impurities;

hot rolling the heated silicon steel slab so as to obtain a hot-rolled steel strip;

annealing the hot-rolled steel strip so as to obtain an annealed steel strip;

cold rolling the annealed steel strip so as to obtain a cold-rolled steel strip;

decarburization annealing the cold-rolled steel strip so as to obtain a decarburization-annealed steel strip wherein primary recrystallization occurs during the decarburization annealing;

coating an annealing separating agent on the decarburization-annealed steel strip; and finish annealing the decarburization-annealed steel strip so as to cause secondary recrystallization, wherein the method further comprises performing a nitriding treatment in which a N content of the decarburization-annealed steel strip is increased between start of the decarburization annealing and occurrence of the secondary recrystallization in the finish annealing, the hot rolling the heated silicon steel slab comprises:

finish rolling with a finish temperature of 950° C. or below; and starting cooling within 2 seconds after completion of the finish rolling, and coiling at 700° C. or below, a heating rate of the hot-rolled steel strip within the temperature range from 800° C. to 1000° C. in the annealing the hot-rolled steel strip is 5° C./sec or above, and a cooling rate over a duration from the completion of the finish rolling up to a start of the coiling is 10° C./sec or above and 16° C./sec or below.

2. The method of manufacturing a grain-oriented electrical steel sheet according to claim 1, wherein a cumulative reduction in the finish rolling is 93% or above.

3. The method of manufacturing a grain-oriented electrical steel sheet according to claim 1, wherein a cumulative reduction in the last three passes in the finish rolling is 40% or above.

4. The method of manufacturing a grain-oriented electrical steel sheet according to claim 2, wherein a cumulative reduction in the last three passes in the finish rolling is 40% or above.

5. The method of manufacturing a grain-oriented electrical steel sheet according to claim 1, wherein the silicon steel slab further contains Cu: 0.05% to 0.4% by mass.

6. The method of manufacturing a grain-oriented electrical steel sheet according to claim 2, wherein the silicon steel slab further contains Cu: 0.05% to 0.4% by mass.

7. The method of manufacturing a grain-oriented electrical steel sheet according to claim 3, wherein the silicon steel slab further contains Cu: 0.05% to 0.4% by mass.

8. The method of manufacturing a grain-oriented electrical steel sheet according to claim 4, wherein the silicon steel slab further contains Cu: 0.05% to 0.4% by mass.

9. The method of manufacturing a grain-oriented electrical steel sheet according to claim 1, wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

10. The method of manufacturing a grain-oriented electrical steel sheet according to claim 2 wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

11. The method of manufacturing a grain-oriented electrical steel sheet according to claim 3 wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

12. The method of manufacturing a grain-oriented electrical steel sheet according to claim 4 wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

13. The method of manufacturing a grain-oriented electrical steel sheet according to claim 5 wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

14. The method of manufacturing a grain-oriented electrical steel sheet according to claim 6 wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

15. The method of manufacturing a grain-oriented electrical steel sheet according to claim 7 wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

16. The method of manufacturing a grain-oriented electrical steel sheet according to claim 8 wherein the silicon steel slab further contains, in % by mass, at least one selected from the group consisting of Cr: 0.3% or less, P: 0.5% or less, Sn: 0.3% or less, Sb: 0.3% or less, Ni: 1% or less, and Bi: 0.01% or less.

17. The method of manufacturing a grain-oriented electrical steel sheet according to claim 1, wherein the cooling rate is 10° C./sec or above and 14° C./sec or below.

* * * * *